US006196413B1

(12) United States Patent
Tung

(10) Patent No.: US 6,196,413 B1
(45) Date of Patent: Mar. 6, 2001

(54) STRUCTURE OF A WATER BOTTLE-STRAW ASSEMBLY

(76) Inventor: Tsai Chong Tung, 12 Lane 175, Wen-Hsien 2nd Road, Tainan City (TW)

( * ) Notice: Subject to any disclaimer, the term of this patent is extended or adjusted under 35 U.S.C. 154(b) by 0 days.

(21) Appl. No.: 09/546,643

(22) Filed: Apr. 10, 2000

(51) Int. Cl.[7] ..... A47G 19/22

(52) U.S. Cl. ..... 220/709; 215/229; 215/388; 239/33; 22/464.5; 220/714; 220/717

(58) Field of Search ..... 239/33, 16; 222/464.5, 222/464.3, 481.5, 482; 215/388, 11.6, 311, 229; 220/705, 707–709, 714, 717

(56) References Cited

U.S. PATENT DOCUMENTS

| | | | | |
|---|---|---|---|---|
| 2,513,896 | * | 7/1950 | Searer | 215/11.5 |
| 2,688,326 | * | 9/1954 | Lerman | 215/11.5 X |
| 2,724,536 | * | 11/1955 | Pugh, Sr. . | |
| 2,815,879 | * | 12/1957 | Hermes | 215/229 X |
| 2,989,961 | * | 6/1961 | Blanchett | 215/11.5 |
| 3,132,776 | * | 5/1964 | Wasserberg . | |
| 3,481,500 | * | 12/1969 | Palma | 215/11.5 |
| 4,785,978 | * | 11/1988 | Kano et al. | 222/482 |
| 4,828,141 | * | 5/1989 | Coy | 220/714 X |
| 4,836,404 | * | 6/1989 | Coy | 220/714 |
| 4,850,533 | * | 7/1989 | Hoshi et al. | 239/33 |
| 4,946,062 | * | 8/1990 | Coy | 220/714 |
| 5,101,991 | * | 4/1992 | Morifuji et al. | 215/11.5 X |
| 5,148,971 | * | 9/1992 | Ahn | 239/33 X |
| 5,234,117 | * | 8/1993 | Garvin | 215/229 X |
| 5,474,028 | * | 12/1995 | Larson et al. | 215/11.5 X |
| 5,878,898 | * | 3/1999 | Shefflin | 220/708 X |
| 6,050,444 | * | 4/2000 | Sugg | 220/707 |
| 6,116,457 | * | 9/2000 | Haberman | 220/714 X |

FOREIGN PATENT DOCUMENTS

| | | | | |
|---|---|---|---|---|
| 2695910 | * | 3/1994 | (FR) | 220/709 |

* cited by examiner

*Primary Examiner*—Allan N. Shoap
*Assistant Examiner*—Robin A. Hylton
(74) *Attorney, Agent, or Firm*—Dougherty & Troxell

(57) ABSTRACT

A water bottle-straw assembly comprising a screw-threaded cap base including a lift-lower cap attached at one side thereof and a through hole in which a suction base is inserted. The suction base has a protruding suction end having a valve and a flange providing an air guiding groove. A straw is inserted into the suction base and a flexible tube is telescopically connected to the lower end of the straw to allow use with containers of varying sizes.

2 Claims, 6 Drawing Sheets

STRUCTURE OF A WATER BOTTLE-STRAW ASSEMBLY

FIELD OF THE INVENTION

The present invention relates to an improved structure of a water bottle-straw assembly and particularly to a water bottle-straw assembly that employs a simple structure and has the advantages of preventing air from being sucked in subsequent suctions, providing better sealing free from water leakage, completely sucking up water in the bottle, and being applicable to water bottles with various capacity depths.

BACKGROUND OF THE INVENTION

In a commercially available water bottle, there is generally provided with a straw assembly for convenience. For example, please refer to FIGS. 1 and 2, which are two side sectional views of a conventional water bottle-straw assembly, illustrating the cap of a lift-lower type used in the assembly is in an open and a closed states, respectively. The straw assembly essentially consists of a cap base 10 and a straw 20. The cap base 10 can be screwed to the open end of a water bottle 30, and a circular groove 11 is provided at the center of the cap base 10. A through hole 12 is fonned on the bottom of the circular groove 11. The cap base 10 is also provided with a cap 13 of a lift-lower type. The straw 20 goes through the through hole 12 of the circular groove 11 and is capped with a sucker 21. A spring 22 is disposed between the sucker 21 and the bottom of the circular groove 11 in such a way that the sucker 21 can be pushed up above the cap base 10 by the spring 22 when the cap 13 is in an open state as shown in FIG. 1, and that the sucker 21 can be pushed down into the circular groove 11 when the cap 13 is in a closed state as shown in FIG. 2. In addition, the lower end of the straw 20 generally approaches the inner bottom of the water bottle 30.

Although such a water bottle-straw assembly can provide convenience in water drinking, there are several drawbacks as described below.

Because the upper end of the straw 20 simply leads to the lower end thereof, the water sucked up in the straw 20 will flow back to the bottle 30 when a user's mouth no longer contains the sucker 21, resulting in that the air will immediately fill in the space above the water level in the straw 20. Consequently, when the user sucks again, he must completely suck the air in the straw 20 before the water in the bottle 30 comes up into his mouth through the straw 20. By the way, the lower the water level is, the more air is sucked. Users usually suck so much air into their stomachs that they may feel sick during or after drinking. When the cap 13 is in a closed state as shown in FIG. 2, it presses against the upper end of the sucker 21. However, since there is a gap between the sucker 21 and the circular groove 11, the water in the bottle 30 can leak out from the circular groove 1 1 through the through hole 12.

During sucking, users, especially children and babies, may be hurt at their teeth because the sucker 21 is usually made of hard plastics.

Furthermore, the straw 20 will move up and down as the sucker 21 moves up and down due to the opening and closing of the cap 13. Accordingly, it is usually a principle that the straw 20 is not so long and does not touch the inner bottom of the water bottle 30 when the cap 13 is in aclosed state, as shown in FIG. 2. Obviously, such a length of the staw 20 always makes a distance between the lower end of the straw 20 and the inner bottom of the water bottle 30 when the cap 13 is in an open state, as shown in FIG. 1. Therefore, users cannot completely suck the water out of the bottle 30, and there is always some water left in the bottle 30 after use.

Thus, there is a need to improve conventional water bottles for better sucking.

SUMMARY OF THE INVENTION

The objective of the present invention is to provide an improved structure of a water bottle-straw assembly, which employs a simple structure and has the advantages of preventing air from being sucked in subsequent suctions, providing better sealing free from water leakage, completely sucking up water in the bottle, and being applicable to water bottles with various capacity depths.

In accordance with the present invention, the improved structure of such a water bottle-straw assembly, comprises:

a cap base screwed to the open end of the water bottle body, wherein a through hole and an air inlet are formed on said cap base, a rabbet groove is provided around said through hole beneath said cap base, and said cap base is also provided with a cap of a lift-lower type at its edge;

a suction base made of silicone and being made integral, wherein a flange is formed around said suction base, a suction end is protruded on said suction base, another flange is formed around the low part of said suction end, a valve is provided at the top of said suction end, an air-guiding groove is formed either on said flange or on the corresponding position beneath said cap base, an air inlet valve is provided in said air-guiding groove;

a straw, the tipper end of which is connected into said suction end of said suction base and the lower end of which touches the inner bottom of the water bottle body;

wherein said suction end goes through said through hole of said cap base in such a way that said two flanges of said suction base are rabbetted with said rabbet groove and the edge of said through hole, respectively, and that said suction end is protruded above said cap base; and wherein said air-guiding groove on said flange corresponds to and is thus air-connected to said air inlet on said cap base.

Moreover, a flexible tube can be telescopically connected to said lower end of said straw, thereby the total length of said straw being adjustable to make said tube touch the inner bottom of the water bottle body by means of telescoping, in order for use in water bottles with various capacity depths.

BRIEF DESCRIPTION OF THE DRAWINGS

The above and other objectives, features and advantages of the invention will become apparent from the following detailed descnption of preferred embodiment in connection with the accompanying drawings in which:

FIG. 3A is a partial, enlarged view of area A in FIG. 3.

Figure 1:
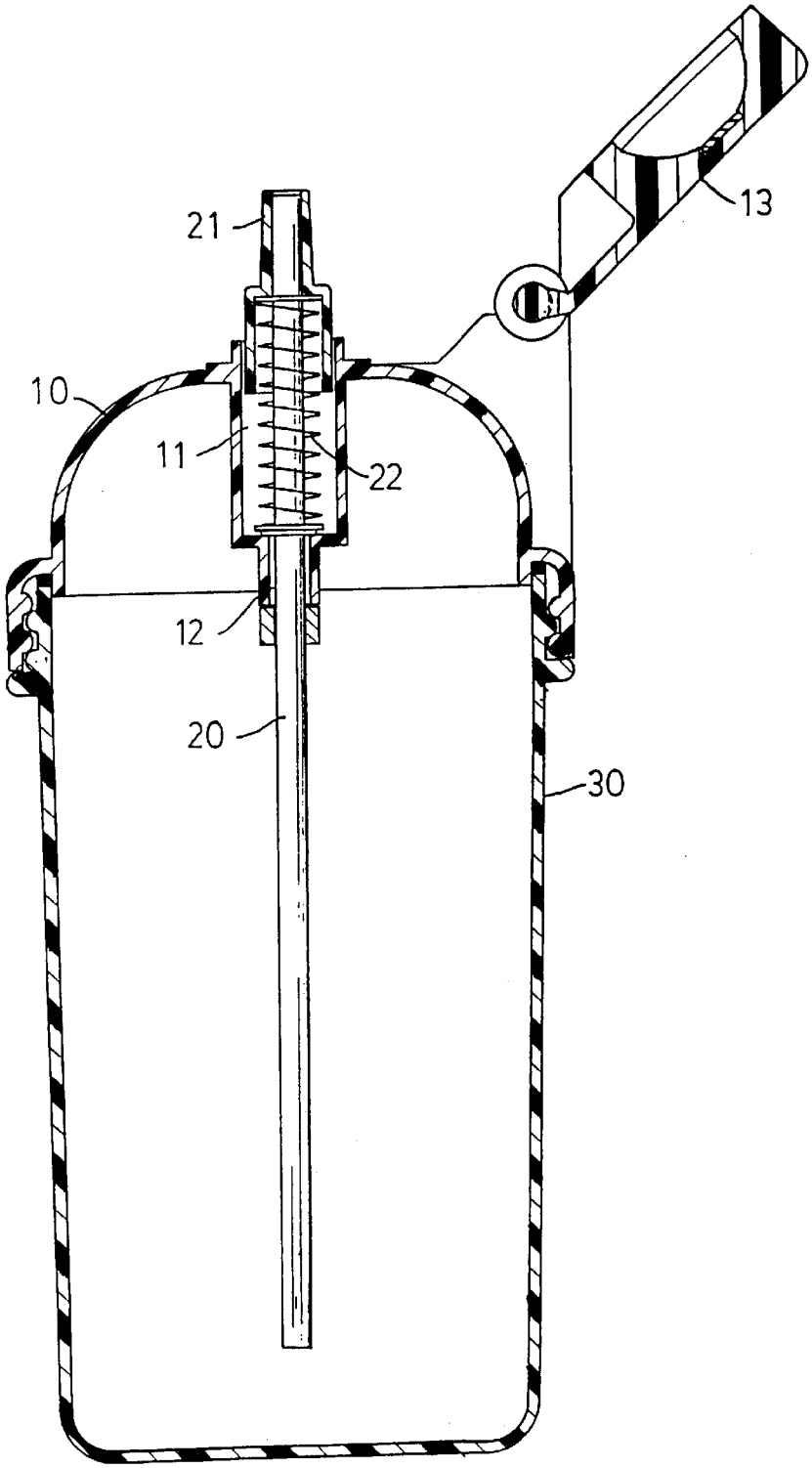
FIG1 (PRIOR ART)
FIG. 1 is a side sectional view of a conventional water bottle-straw assembly, illustrating the cap of a lift-lower type used in the assembly in an open state.
Figure 2:
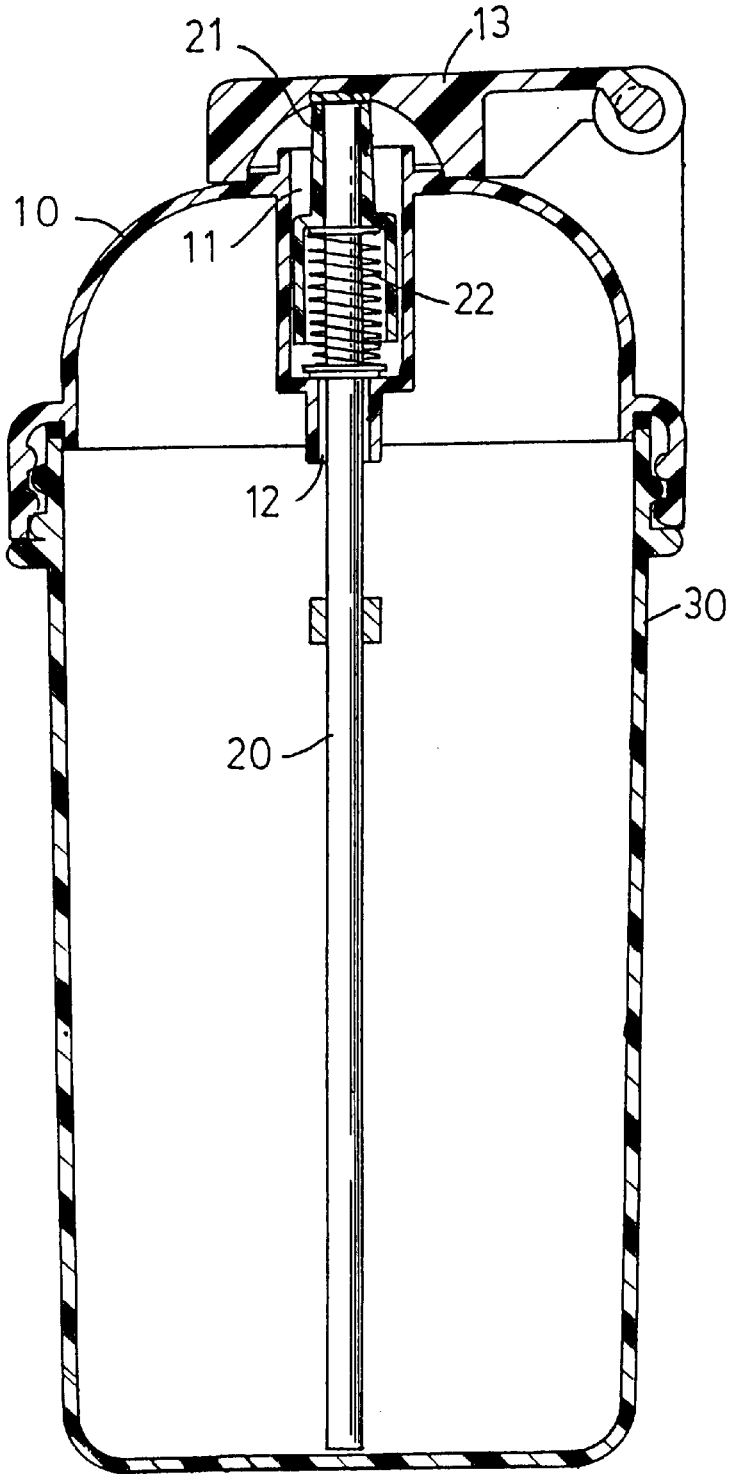
FIG2 ( PRIOR ART)
FIG. 2 is a side sectional view of the assembly shown in FIG. 1, illustrating the cap of a lift-lower type used in the assembly in a closed state.

It is noted that the drawings of the invention are not to scale. The drawings are merely schematic representations, not intended to portray specific parameters of the invention, rather to illustrate the principles of the invention. The drawings are intended to depict only a typical embodiment of the invention and therefore should not be considered as limiting the scope of the invention.

Reference Numerals of the Elements in the Drawings

| | | | |
|---|---|---|---|
| 10 | cap base | 44 | cap of a lift-lower type |
| 11 | circular groove | 50 | suction base |
| 12 | through hole | 51 | flange |
| 13 | cap of a lift-lower type | 52 | suction end |
| 20 | straw | 53 | flange |
| 21 | sucker | 54 | valve |
| 22 | spring | 55 | air-guiding groove |
| 30 | water bottle | 56 | air inlet valve |
| 40 | cap base | 60 | straw |
| 41 | through hole | 61 | tube |
| 42 | air inlet | 70 | water bottle body |
| 43 | rabbet groove | | |

DETAILED DESCRIPTION OF THE PREFERRED EMBODIMENT

Figure 3:
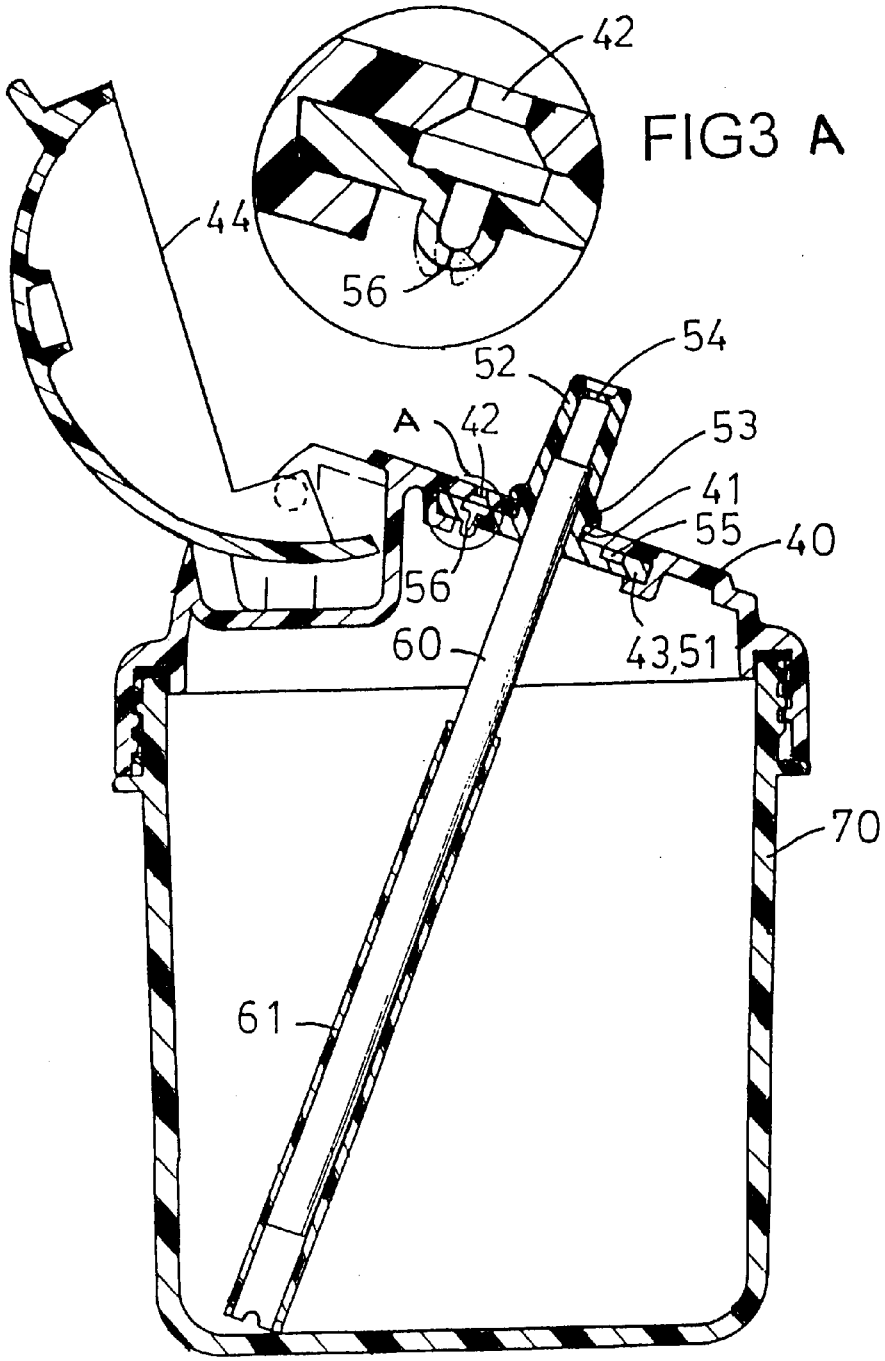
FIG. 3 is a side sectional view of the water bottle-straw assembly in accordance with the embodiment of the present invention.
Figure 4:
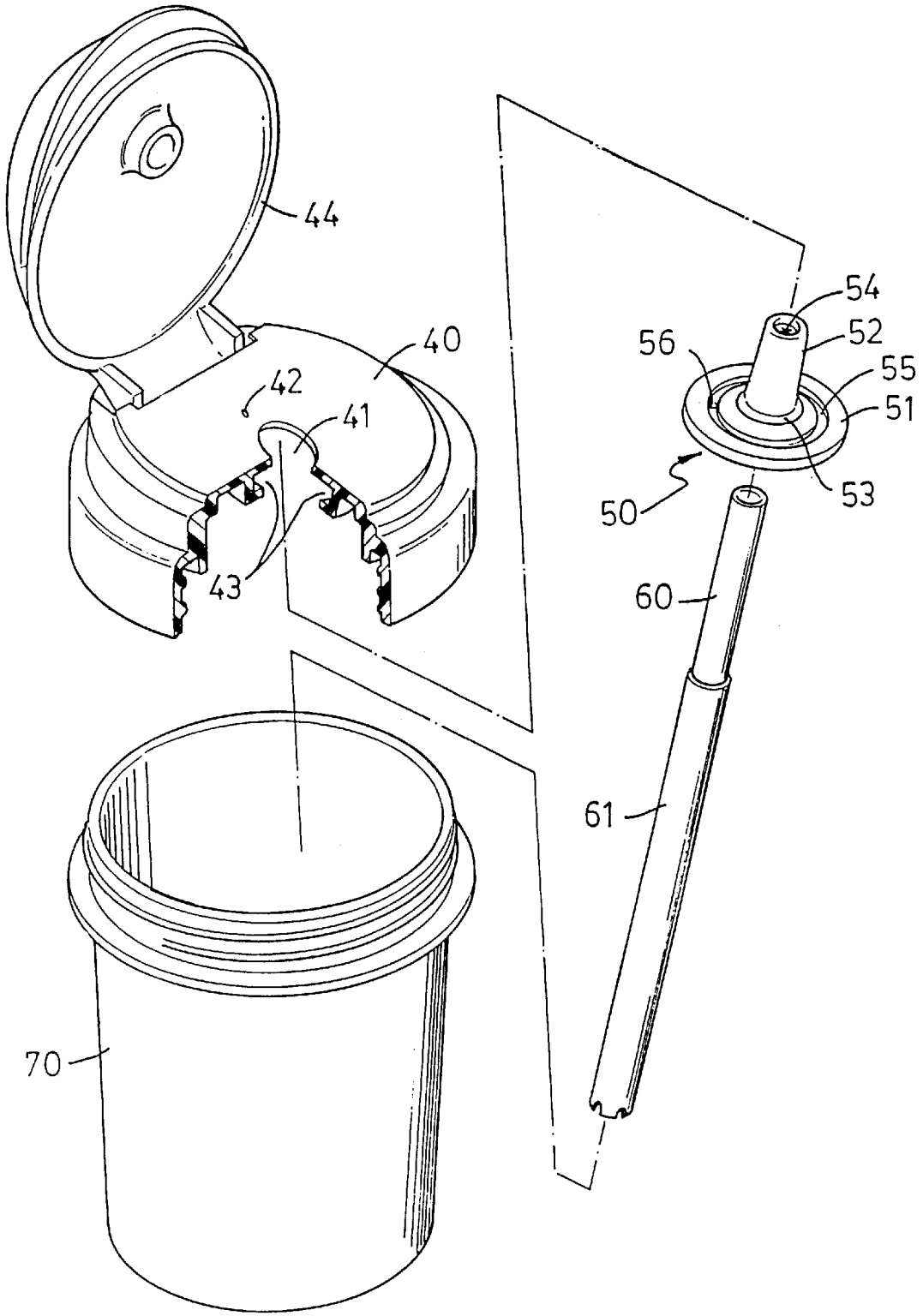
FIG. 4 is an exploded view of the assembly shown in FIG. 3, wherein the cap of a lift-lower type used in the assembly is in an open state.
Figure 5:
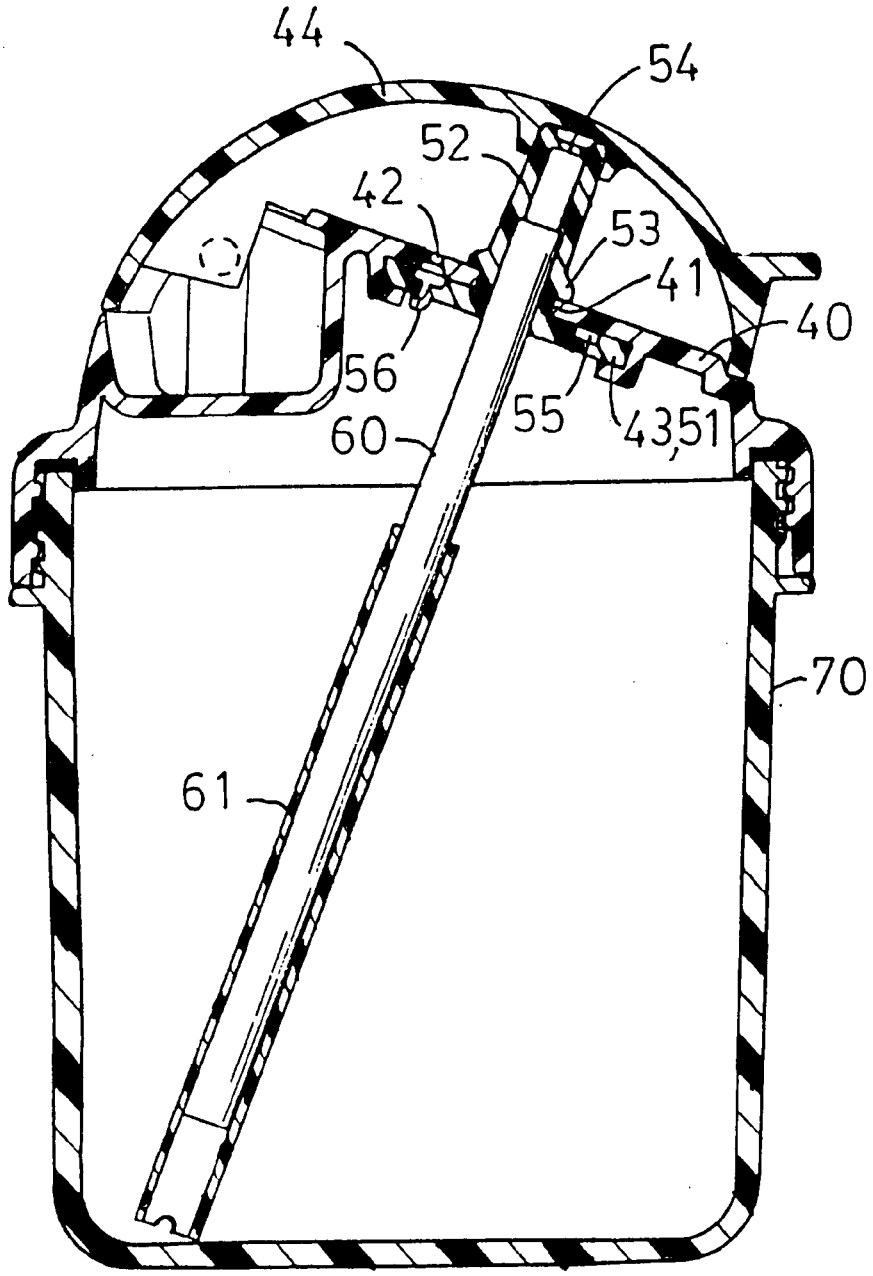
FIG. 5 is a side sectional view of the assembly shown in FIG. 3, wherein the cap of a lift-lower type used in the assembly is in a closed state.
Figure 6:
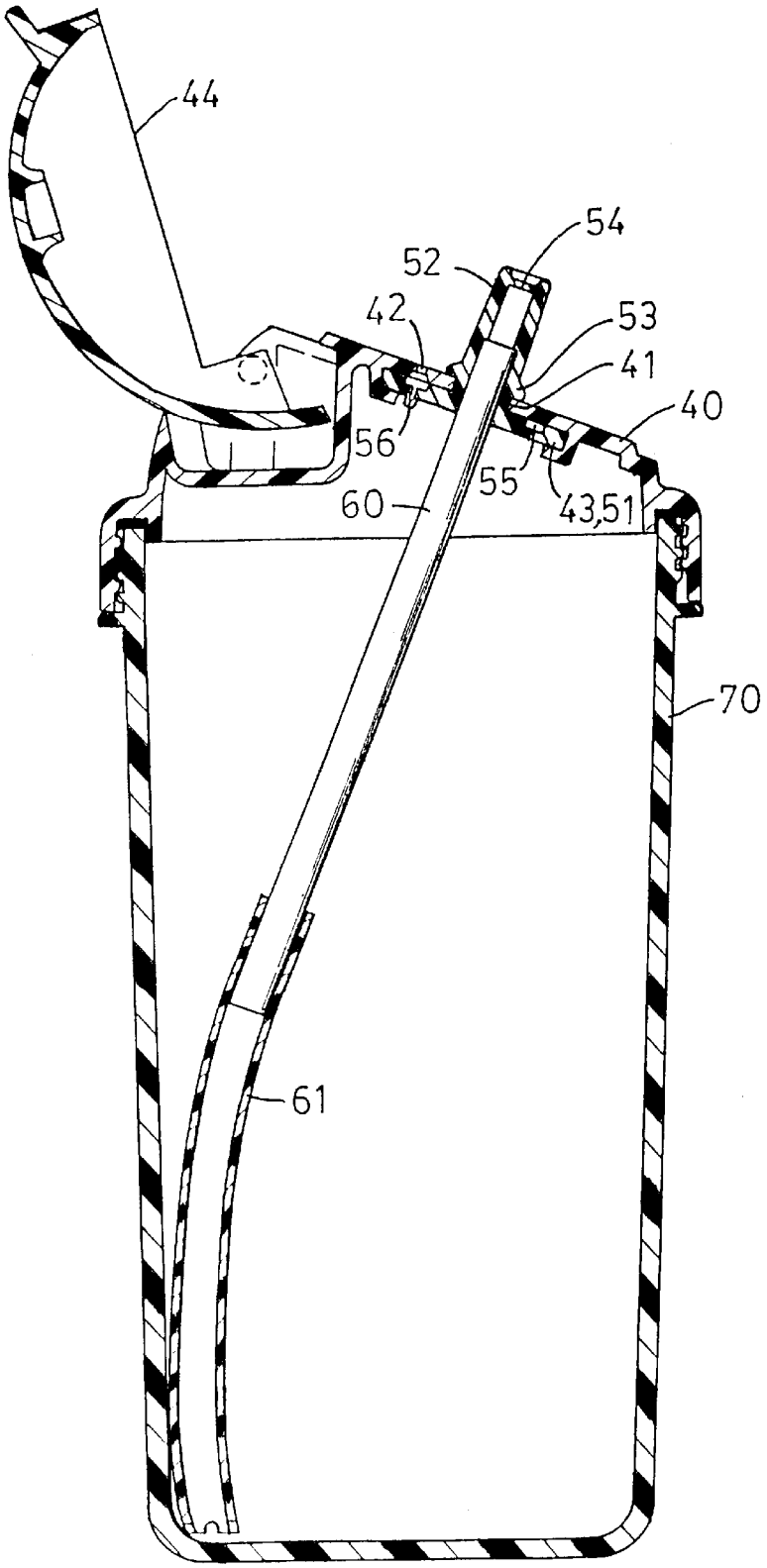
FIG. 6 is a side sectional view of the assembly in accordance with the embodiment of the present invention applied to another water bottle that has a different size from the water bottle shown in FIG. 3.

A water bottle-straw assembly will be described below as a preferred embodiment of the present invention. It should be understood, however, that the present disclosure is to be considered as an exemplification of the principles of this invention and is not intended to limit the invention to the illustrated embodiment FIG. 3 is an exploded view of the water bottle-straw assembly in accordance with the embodiment of the present invention. FIGS. 4 and 5 are two side sectional views of the assembly shown in FIG. 3. The assembly comprises a cap base 40, a suction base 50, and a straw 60.

The cap base 40 can be screwed to the open end of a water bottle body 70. A through hole 41 and an air inlet 42 are formed on the cap base 40. A rabbet groove 43 is provided around the through hole 41 beneath the cap base 40. The cap base 40 is also provided with a cap 44 of a lift-lower type at its edge.

The suction base 50 is made of silicone, for example, and is made integral. A flange 51 is formed around the suction base 50, and a suction end 52 is protruded thereon. Another flange 53 is formed around the low part of the suction end 52, and a valve 54, for example of a cross-type, is provided at the top of the suction end 52. An air-guiding groove 55 is formed either on the flange 51 or on the corresponding position beneath the cap base 40. An air inlet valve 56, for example of a cross-type, is provided in the air-guiding groove 55. The suction end 52 goes through the through hole 41 of the cap base 40 in such a way that the flanges 51 and 53 are rabbetted with the rabbet groove 43 and the edge of the through hole 41, respectively, and that the suction end 52 is protruded above the cap base 40. The air-guiding groove 55 on the flange 51 corresponds to and is thus air-connected to the air inlet 42 on the cap base 40.

The upper end of the straw 60 is connected into the suction end 52 of the suction base 50. In order for use in water bottles with various capacity depths, a flexible tube 61 is telescopically connected to the lower end of the straw 60. Accordingly, the total length of the straw 60 can be easily adjusted to make the tube 61 touch the inner bottom of the water bottle body 70 by means of telescoping.

In accordance with the embodiment of the present invention, the flanges 51 and 53 of the suction base 50 are rabbetted with the rabbet groove 43 of the cap base 40 and the edge of the through hole 41 of the cap base 40, respectively. The suction end 52 is protruded on the suction base 50. Moreover, the air-guiding groove 55 on the flange 51 corresponds to and is thus air-connected to the air inlet 42 on the cap base 40 so that the air can fluently enter the water bottle body 70 during suction. Hence, users can suck the water fluently.

It is noted that, due to the provision of the valve 54 at the top of the suction end 52, the air can flow only into the water bottle body 70 through the valve 54. Thus, when users stop sucking, it is possible to prevent the water sucked up in the straw 60 from flowing back to the water bottle body 70 because the valve 54 automatically close the air path at that time. Consequently, air will not be sucked into an user's mouths in their subsequent suctions. It is also noted that the valve 54 at the top of the suction end 52 and the air inlet valve 56 in the air-guiding groove 55 automatically close the air path while an user does not suck. Therefore, the water bottle body 70 is substantially sealed at that time due to the provision of the valve 54 and the air inlet valve 56. The water in the bottle is free from leakage even if the bottle is tilt or down.

Furthermore, due to the flexible tube 61 telescopically connected to the lower end of the straw 60, the total length of the straw 60 can be easily adjusted to make the tube 61 touch the inner bottom of the water bottle body 70 by means of telescoping. Thus, no matter how deep the water bottle is, it is certain that users can completely suck the water out of the bottle without difficulty. No matter the cap 44 is in an open or close state, the straw 60 will not move up and down.

Because the suction base 50 is made of silicone that is relatively softer than plastics, it is safe, especially for children and babies, to use such a suction base.

While the invention has been described with specific reference to the embodiment, someone skilled in the art will recognize that changes can be made in form and detail without departing from the spirit and the scope of the invention. All changes that come within the meaning and range of equivalency of the claims are to be embraced within their scope.

What is claimed is:

1. An improved structure of a water bottle-straw assembly, comprising:

a water bottle body having an open end and a closed end;

a cap base screwed to the open end of the water bottle body, wherein a through hole and an air inlet are formed on said cap base, a rabbet groove is provided around said through hole beneath said cap base, and said cap base is also provided with a lift-lower cap at its edge;

a suction base made of silicone and being made integral, wherein a first flange is formed around said suction base, a suction end is protruded on said suction base, a second flange is formed around the low part of said suction end, a valve is provided at the top of said suction end, an air-guiding groove is formed said first flange and, an air inlet valve is provided in said air-guiding groove;

a straw, the upper end of which is connected into said suction end of said suction base and the lower end of which touches the inner bottom of the water bottle body;

wherein said suction end goes through said through hole of said cap base in such a way that said two flanges of said suction base are rabbetted with said rabbet groove and the edge of said through hole, respectively, and that said suction end is protruded above said cap base; and wherein said air-guiding groove on said flange corresponds to and is thus air-connected to said air inlet on said cap base.

2. The improved structure according to claim 1, wherein a flexible tube is telescopically connected to said lower end of said straw, thereby the total length of said straw being adjustable to make said tube touch the inner bottom of the water bottle body by means of telescoping, in order for use in water bottles with various capacity depths.

* * * * *